US005860474A

United States Patent [19]

Stoltz et al.

[11] Patent Number: 5,860,474

[45] Date of Patent: Jan. 19, 1999

[54] THROUGH-TUBING ROTARY DRILLING

[75] Inventors: Daniel S. Stoltz; David G. Nims, both of Anchorage, Ak.

[73] Assignee: Atlantic Richfield Company, Los Angeles, Calif.

[21] Appl. No.: 882,970

[22] Filed: Jun. 26, 1997

[51] Int. Cl.[6] ..... E03B 3/11

[52] U.S. Cl. ..... 166/50; 166/117.5; 175/61; 175/81

[58] Field of Search ..... 175/61, 62, 81; 166/117.5, 382, 50, 384

[56] References Cited

U.S. PATENT DOCUMENTS

| | | | |
|---|---|---|---|
| 5,188,190 | 2/1993 | Skaalure | 175/81 X |
| 5,211,715 | 5/1993 | Braden et al. | 175/58 |
| 5,301,760 | 4/1994 | Graham | 175/61 |
| 5,379,845 | 1/1995 | Blount et al. | 175/61 X |
| 5,383,522 | 1/1995 | Hailey | 175/61 X |
| 5,423,387 | 6/1995 | Lynde | 175/61 |
| 5,452,759 | 9/1995 | Carter et al. | 175/81 X |
| 5,484,021 | 1/1996 | Hailey | 175/79 X |

OTHER PUBLICATIONS

"Million Dollar Well", Kay Cashman, Petroleum News Alaska, pp. 1, 8 & 23, Nov. 18–Dec. 15, 1996.

"BP Downhole Talk", British Petroleum Corporation, Dec. 1996, Issue 65., pp. 4 & 5.

*Primary Examiner*—Roger Schoeppel

*Attorney, Agent, or Firm*—F. Lindsey Scott

[57] ABSTRACT

A method for recompleting a wellbore containing a casing and a tubing string extending from a surface through the casing to a zone of interest by through-tubing rotary drilling by forming an opening through the casing at a selected point, passing a rotatable drill string including a drill bit through the tubing and drilling a second wellbore by drilling out of the cased wellbore through the opening.

8 Claims, 2 Drawing Sheets

THROUGH-TUBING ROTARY DRILLING

BACKGROUND OF THE INVENTION

1. Field of the Invention

This invention relates to a method for recompleting a cased wellbore using through-tube rotary drilling.

2. Brief Description of the Prior Art

Many oil fields are produced by drilling a wellbore to extend from a surface into an oil bearing formation, casing the wellbore from the surface to or through the oil bearing formation, perforating the casing if it extends through the oil bearing formation, to provide fluid communication between the interior of the casing and the oil bearing formation and positioning a production tubing string in the casing to extend from a depth in or slightly above the oil bearing formation to the surface for the production of fluids from the oil bearing formation. Such wells are used to produce fluids such as oil, gas, water and mixtures thereof from subterranean oil bearing formations under the formation pressure. In other instances, a pump may be used to cause the fluids to flow to the surface. After a period of production, the oil bearing formation surrounding the wellbore becomes depleted so that fluids do not flow into the wellbore and upwardly through the tubing for production. In such instances, a pump may be lowered through a smaller tubing into the formation and fluids may then be pumped to the surface until the flow of fluids from the oil bearing formation stops or drops to an uneconomical level.

In many instances, other areas of the oil bearing formation in the vicinity of the wellbores may not be depleted. Unfortunately, it is expensive to remove the tubing and sidetrack the well through the existing well casing using conventional sidetracking methods. Such methods require that the tubing be removed, a section of the casing be milled out and a drill be run back down through the casing and directed outward through the milled-out section to drill a directional well from the casing outwardly to an area from which additional hydrocarbons may be recovered. Since these techniques are relatively expensive, the amount of potential hydrocarbon recovery required to justify such sidetracking operations is relatively large. Since, in many instances, areas of potentially recoverable hydrocarbons containing less than the amount required to justify this additional expense are known, it is desirable that a more economical method be developed to enable the economical recovery of these smaller quantities of hydrocarbons. The smaller quantities of hydrocarbons may, in fact, be quite sizeable.

One method which has been used in an attempt to reach such hydrocarbons is the use of coiled-tubing drilling. By this method, coiled tubing is used to pass a drill downwardly through the existing tubing and outwardly through an opening in the well casing and drilling a directional well to reach additional hydrocarbons. The use of coiled tubing permits the use of a liquid-driven motor (mud motor) drill supported on coiled tubing. The coiled tubing is not rotatable and is subject to sliding friction and sticking in the existing tubing in the wellbore, the drilled well, and the like. As a result, this method is limited in the length of holes that can be drilled because of the sliding friction of the non-rotatable coiled tubing.

Since, in many instances, drilling to greater distances than previously reachable by the use of coiled tubing is necessary, a continuing effort has been directed to the development of an improved method whereby additional hydrocarbons can be reached.

SUMMARY OF THE INVENTION

According to the present invention, additional hydrocarbons can be reached by a method for recompleting a wellbore containing a casing and a tubing string, extending from a surface through the casing to a zone of interest by through-tubing rotary drilling wherein the method comprises: forming an opening through the casing at a selected point; passing a rotatable drill-string, including a drill bit downwardly through the tubing; and, drilling a second wellbore by drilling out of the cased wellbore through the opening.

DESCRIPTION OF THE PREFERRED EMBODIMENTS

In the description of the FIGs, the same numbers will be used throughout to refer to the same or similar components.

Figure 1:
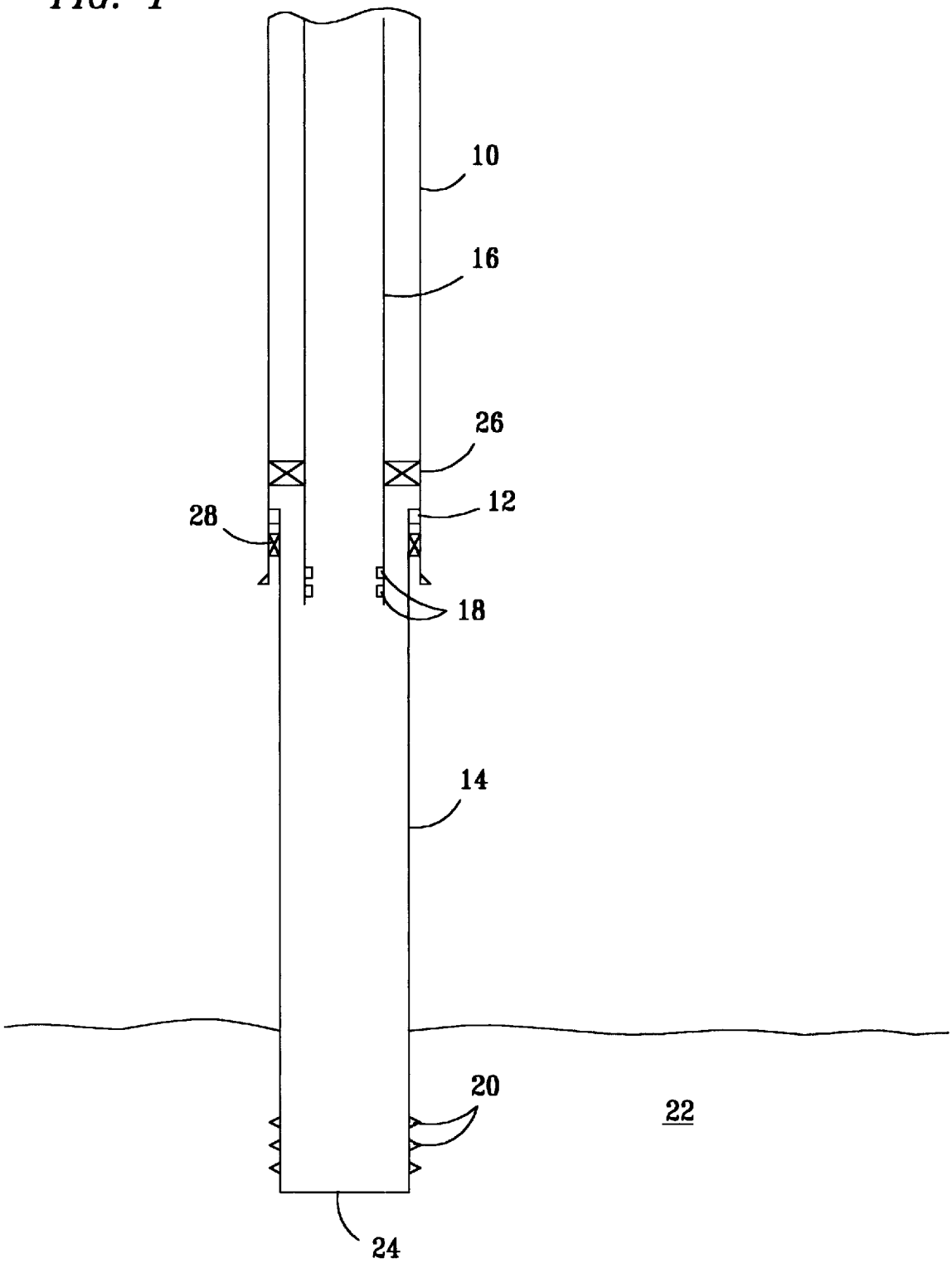
FIG. 1 shows a lower portion of a wellbore used to recover hydrocarbons from an oil-bearing formation; and, FIG. 2 shows a lower portion of a similar well containing a rotary drill string including a bottom-hole drilling assembly in accordance with an embodiment of the present invention.
Figure 2:
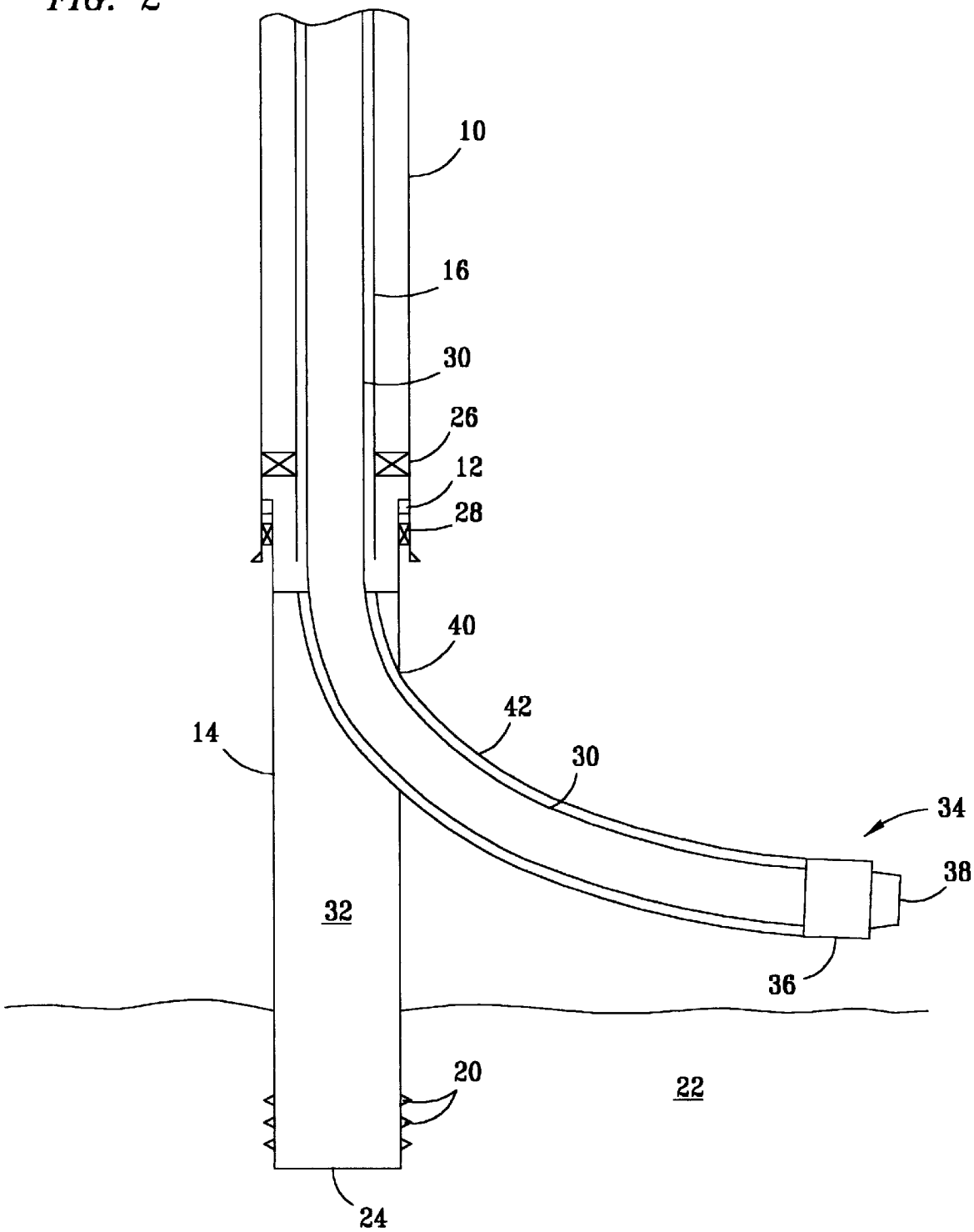

In FIG. 1, the bottom portion of a wellbore is shown. The wellbore extends to the surface and, as shown, has been cased with a casing 10 which, as known to those skilled in the art, is generally cemented in place. Casing 10 extends to a selected depth in the formation and includes a casing hanger 12 from which a smaller casing 14 has been extended. Casing 10 also contains a tubing string 16 which extends through casing 10 and casing 14 to a selected depth and includes projections 18 such as hangers and the like on a its lower end to permit the installation of a smaller tubing string which could include a pump during the later stages of production from a subterranean oil bearing formation 22 in fluid communication with the inside of casing 14 via a plurality of perforations 20. Perforations 20, as shown, are located near a bottom 24 of casing 14. A packer 26 is positioned between casing 10 and tubing string 16 to prevent fluid communication through the annulus between the outside of tubing string 16 and the inside of casing 10. Similarly, a packer 28 is positioned between the inside of casing 10 and the outside of casing 14.

During the producing life of oil bearing formation 22, oil or gas may be recovered from formation 22 by flowing outwardly from formation 22 through perforations 20 into casing 14 and then upwardly through tubing string 16 to the surface for recovery. Oil, gas or mixtures of oil, gas and water in any combination may be recovered from subterranean oil bearing formations. After the formation has declined in production, it may be necessary to use a pump to cause the flow of fluids to the surface. After the formation ceases to yield hydrocarbons in sufficient quantities to justify continued production, the pump can be removed leaving tubing string 16 in place as shown.

Conventional sidetracking techniques require that the tubing, packers and the like be removed and that a section of the casing be removed to provide a window for drilling from the casing using conventional drilling techniques. Such techniques are well known to those skilled in the art and result in the production of a smaller diameter wellbore which is completed to extend into a desired zone from which it is anticipated additional hydrocarbons may be produced. Normally, such wells are then cased with the casing being cemented in place and completed as known to those skilled in the art in view of the particular formation to be produced.

The removal of the tubing and associated equipment is an expensive operation and it would be desirable if the wells could be used more economically to produce additional hydrocarbons by reaching other areas of oil bearing formation 22 or other oil bearing formations available in the vicinity.

According to the present method, through-tubing rotary drilling is used to drill a well from the existing wellbore to reach additional hydrocarbons. In the practice of the method of the present invention, casing 14 is cemented shut to a level above the desired kickoff point. The kick-off or selected point is that level at which it is desired to drill out of the existing wellbore. According to the present method, a rotary drilling string 30 of a diameter less than the inside diameter of the tubing is passed downwardly through tubing string 16 and into engagement with casing 14. The rotary drill string includes a mill which is directed into engagement with casing 14 by a whipstock or the like. A diamond mill is used frequently in combination with a liquid driven motor (mud motor) to mill a hole 40 through casing 14. The bit may also be used to mill out projections 18 in tubing string 16. This is then withdrawn and a conventional drill bit 38, typically a polycrystalline diamond drill bit is used in combination with a directional bottom hole assembly 34 to drill a well directionally from casing 14. Conventional directional bottom hole assemblies include components such as a bit (typically polycrystalline diamond bit 38, stabilizers [not shown], a mud motor used to drive the bit [not shown], a measurement while drilling assembly 36, drill collars [not shown] and the like) as well known to those skilled in the art for such drilling. The use of the rotary drill string permits the drilling of holes to a greater distance Man when techniques using coiled-tubing are used since sliding friction of the drill string is overcome to a large extent by the rotation of the drill string. Energy for driving the drill bit is supplied by a combination of the rotation of the drill string and a liquid-driven motor. The liquid-driven motor may be driven by a drilling fluid or other fluids. Typically, the motor is a drilling fluid-driven motor (mud motor).

After a second wellbore 42 has been drilled, rotary drilling string 30 is withdrawn and a liner (not shown) is run into second wellbore 42. The liner may be cemented in place, if desired. In such instances, the liner is typically perforated in areas considered suitable for fluid production so that fluids can be produced through the liner A smaller tubing string may be run into the liner for clean-out or other well servicing operations. Such variations are considered known by those skilled in the art once second wellbore 42 is in place.

By the use of the present invention, the tubing is left in place and wells may be directionally drilled more economically from the wellbore penetrating the played-out formation using conventional drilling rigs with minor modifications. The use of the existing wells by the present invention can greatly increase the number of areas of hydrocarbons which can be accessed economically for the production of additional hydrocarbon fluids. The apparatus required for implementation of the method of the present invention is available to the art for other purposes and is readily adapted to use in the method of the present invention and will not be described in any additional detail.

To date, wells drilled by the method of the present invention have been extended to a total depth of over three miles with extensions from the existing wells of over three thousand feet from the opening in the casing in the initial wellbore. It is anticipated that well extensions can be drilled to substantially greater lengths using the method of the present invention.

While the wells shown are vertical wells, it should be understood that the method of the present invention can also be used in slanted wells at substantially any angle up to and including horizontal wells.

Having thus described the invention by reference to certain of its preferred embodiments, it is respectfully pointed out that the embodiments described are illustrative rather than limiting in nature and that many variations and modifications are possible within the scope of the present invention. Many such variations and modifications may appear obvious and desirable to those skilled in the art based upon a review of the foregoing description of preferred embodiments.

Having thus described the invention, we claim:

1. A method for recompleting a cased wellbore containing a casing and a tubing string extending downwardly from a surface through the casing to a zone of interest by through tubing rotary drilling, the method comprising:

a) cementing the cased wellbore shut with cement from its bottom to a level above a selected point;

b) forming an opening through the casing at the selected point;

c) passing a rotatable drill string including a drill bit downwardly through the tubing;

d) drilling a second wellbore by drilling out of the cased wellbore through the opening; and, e) positioning a liner in the second wellbore.

2. The method of claim 1 wherein the opening is formed by passing a rotary drill string including a milling apparatus through the tubing and milling the opening through the casing.

3. The method of claim 2 wherein the milling apparatus is urged into engagement with the casing by a whipstock.

4. The method of claim 2 wherein the milling apparatus comprises a diamond mill driven by a liquid driven motor.

5. The method of claim 2 wherein the rotatable drill string includes a drill bit driven by a liquid driven motor.

6. The method of claim 2 wherein the rotatable drill string includes a measurement while drilling assembly.

7. The method of claim 1 wherein the liner is cemented in the second wellbore.

8. The method of claim 7 wherein the liner is perforated in selected zones.

* * * * *